US006830487B2

(12) United States Patent
Kluempke

(10) Patent No.: US 6,830,487 B2
(45) Date of Patent: Dec. 14, 2004

(54) PIN JACK FOR A DIGITAL SWITCHING CROSS-CONNECT MODULE

(75) Inventor: Shari K. Kluempke, Burnsville, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 10/199,984

(22) Filed: Jul. 19, 2002

(65) Prior Publication Data

US 2004/0014366 A1 Jan. 22, 2004

(51) Int. Cl.[7] ..... H01R 24/04
(52) U.S. Cl. ..... 439/668; 439/188
(58) Field of Search ..... 439/668, 188, 439/557, 669, 49, 53

(56) References Cited

U.S. PATENT DOCUMENTS

| | | | | | |
|---|---|---|---|---|---|
| 3,989,343 | A | | 11/1976 | Lucius et al. | 439/557 |
| 4,073,563 | A | * | 2/1978 | Bailey et al. | 439/532 |
| 4,687,291 | A | | 8/1987 | Stape et al. | 385/59 |
| 4,749,968 | A | | 6/1988 | Burroughs | 333/105 |
| 4,768,961 | A | | 9/1988 | Lau | 439/61 |
| 4,815,104 | A | | 3/1989 | Williams et al. | 375/36 |
| 5,147,992 | A | | 9/1992 | Eriksen et al. | 200/51.1 |
| 5,214,673 | A | * | 5/1993 | Morgenstern et al. | 375/257 |
| 5,233,501 | A | * | 8/1993 | Allen et al. | 361/733 |
| 5,246,378 | A | | 9/1993 | Seiceanu | 439/188 |
| 5,348,491 | A | | 9/1994 | Louwagie et al. | 439/188 |
| 5,413,494 | A | * | 5/1995 | Dewey et al. | 439/188 |
| 5,467,062 | A | | 11/1995 | Burroughs | 333/124 |
| 5,538,438 | A | | 7/1996 | Orlando | 439/344 |
| 5,577,924 | A | * | 11/1996 | Louwagie | 439/188 |
| 5,913,701 | A | | 6/1999 | Olson et al. | 439/668 |
| 6,019,521 | A | | 2/2000 | Manning et al. | 385/77 |
| 6,045,378 | A | * | 4/2000 | Follingstad | 439/188 |
| 6,132,259 | A | * | 10/2000 | Chapman et al. | 439/668 |
| 6,241,562 | B1 | * | 6/2001 | Benda et al. | 439/731 |
| 6,287,149 | B1 | | 9/2001 | Elkhatib et al. | 439/610 |
| 6,328,608 | B1 | * | 12/2001 | Olson et al. | 439/668 |
| 6,352,444 | B1 | | 3/2002 | Yuzawa | 439/353 |
| 6,589,062 | B1 | * | 7/2003 | Ogren et al. | 439/188 |
| 2002/0076964 | A1 | | 6/2002 | Weisz-Margulescu | 439/263 |

OTHER PUBLICATIONS

Fig. 1 of admitted prior art from application.
Brochure, "Video Signal Distribution Products," *ADC Telecommunications*, pp. 47, (Oct. 1996).
Exhibit A: ADC Telecommunications illustrates 3 views of digital cross–connect module with switching device. (Date: This art was known of prior to filing of present U.S. patent application Ser. No. 10/199,981.).

* cited by examiner

*Primary Examiner*—Michael C. Zarroli
(74) *Attorney, Agent, or Firm*—Merchant & Gould P.C.

(57) ABSTRACT

A pin jack for use with a DSX system is disclosed. The pin jack includes a pin jack housing configured to be secured within an opening defined by a piece of telecommunications equipment. The pin jack housing including first and second ends. Two conductor mounting openings extend between the first and second ends. Conductors are mounted within the conductor mounting openings. The conductors include sockets accessible from the first end of the pin jack housing and tails that project from the second end of the pin jack housing.

25 Claims, 9 Drawing Sheets

PIN JACK FOR A DIGITAL SWITCHING CROSS-CONNECT MODULE

FIELD OF THE INVENTION

The present invention relates generally to digital cross-connect equipment. More particularly, the present invention relates pin jacks used to interconnect tracer lamp circuits of cross-connected switching modules.

BACKGROUND OF THE INVENTION

In the telecommunications industry, the use of switching jacks to perform cross-connect and monitoring functions is well known. The jacks may be mounted to replaceable cards or modules, which in turn may be mounted in a chassis, and multiple chassis may be mounted together in an equipment rack. Modules for use in co-axial environments are described in U.S. Pat. No. 5,913,701, which is incorporated herein by reference. Modules for use in twisted pair applications are described in U.S. Pat. No. 6,116,961. Cross-connect modules are also used with fiber optic communications systems.

FIG. 1 shows a prior art cross-connect arrangement of the type used for co-axial applications. The depicted arrangement includes two jack modules 20, 22. The jack modules 20, 22 may be mounted in separate chassis that are in turn mounted on separate racks. Each jack module 20, 22 is cabled to a separate network element (i.e., piece of telecommunications equipment). For example, jack module 20 is connected to equipment 24 by cables 26, and jack module 22 is connected to equipment 28 by cables 30. The pieces of equipment 24 and 28 are interconnected by cross-connect jumpers 32 placed between the two jack modules 20 and 22. Each jack module 20, 22 includes IN and OUT ports 34 and 36 for direct access to the equipment's input and output signals. Each module 20, 22 also includes X-IN and X-OUT ports 35, 37 for providing direct access to the cross-connect input and cross-connect output signals. Ports 34–37 provide a means to temporarily break the connection between the pieces of equipment 24 and 28 that are cross-connected together, and to allow access to the signals for test and patching operations. The jack modules 20, 22 also include monitor ports 38 for non-intrusive access to the input and output signals of each piece of telecommunications equipment 24, 28.

A typical telecommunications central office includes many jack modules and a large number of bundled cables interconnecting the modules. Consequently, absent indicators, it is difficult to quickly determine which two jack modules are cross-connected together. To assist in this function, the jack modules 20, 22 include indicator lights 40 wired to power 42 and ground 44. Switches 46 are positioned between the indicator lights 40 and ground 44. The indicator lights 40 are also electrically connected to pin jacks 48 located at the rear of the jack modules 20, 22. The pin jacks 48 provide connection locations for allowing the tracer lamp circuits corresponding to each of the modules 20, 22 to be interconnected by a cable 50 (i.e., a wire). The cable 50 is typically bundled with the cross-connect cables 32. When either switch 46 is closed, the indicator lamps 40 corresponding to both of the jack modules 20, 22 are connected to ground and thereby illuminated. Thus, by closing one of the switches 46, the two jack modules 20, 22 that are cross-connected can be easily identified by merely locating the illuminated tracer lamps.

SUMMARY

The present disclosure describes representative embodiments that include examples of how a number of different inventive concepts can be practiced. It will be appreciated that the inventions can be used together or separately from one another. It will further be appreciated that the examples embodying the inventive concepts are merely illustrative, and that variations can be made with respect to the depicted examples without departing from the broad scope of the inventive concepts.

Example embodiments disclosed herein relate to pin jacks that provide connection locations for interconnecting the tracer lamp circuits of cross-connected DSX jacks.

BRIEF DESCRIPTION OF THE DRAWINGS

The accompanying drawings, which are incorporated in and constitute a part of the specification, illustrate various embodiments that are examples of how certain inventions can be put into practice. A brief description of the drawings is as follows.

DETAILED DESCRIPTION

Figure 11:
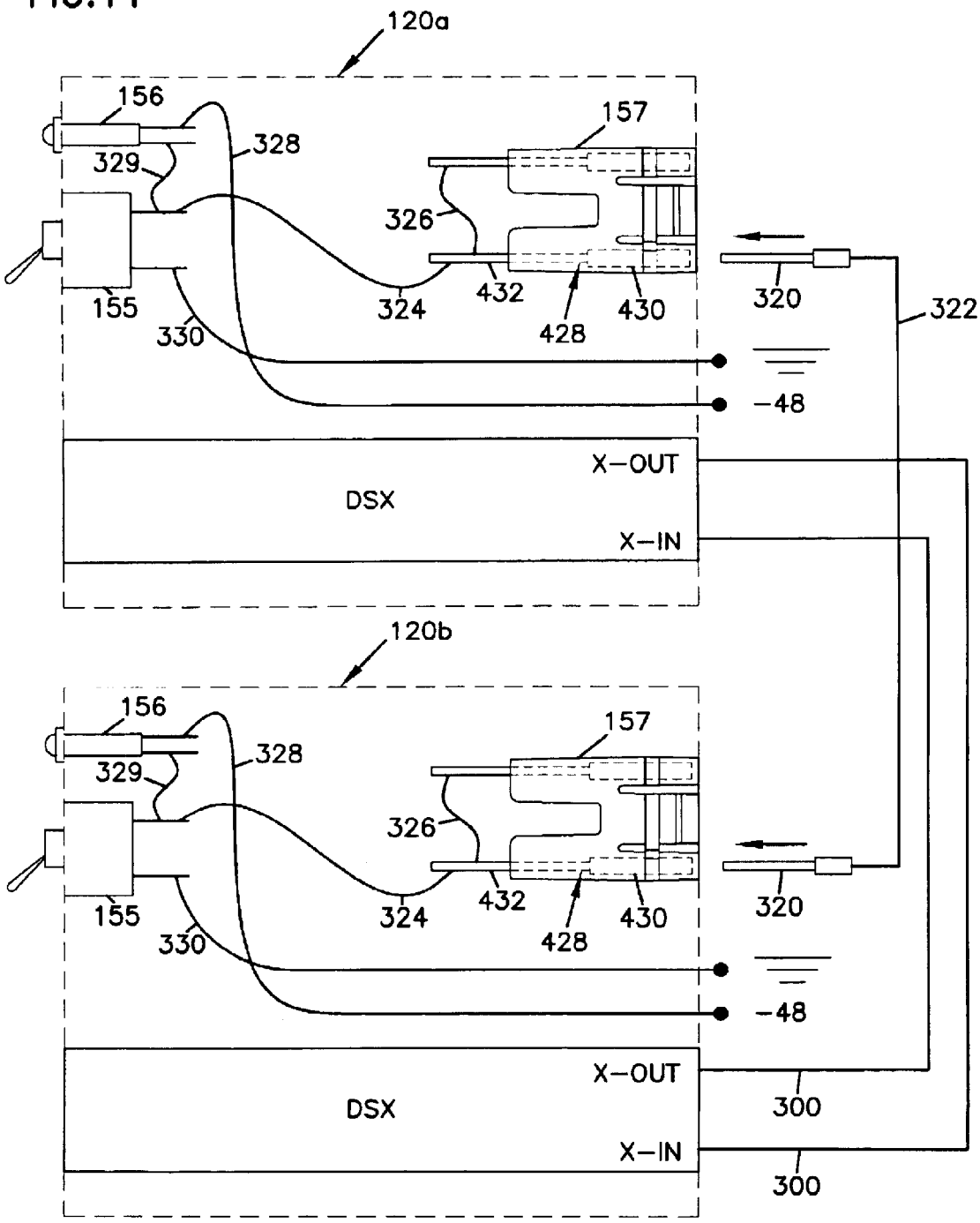
FIG. 11 schematically depicts an electrical connection between tracer lamp circuits of two DSX modules each including the pin jack of FIG. 2.

FIGS. 2–6 illustrate a pin jack 157 having features that are examples of how various inventive concepts disclosed herein can be put into practice. Generally, the pin jack 157 includes a housing 158 having mounting structure (e.g., resilient latches 434) for coupling the pin jack to a piece of telecommunications equipment such as a panel or a jack module. The pin jack 157 also includes a pair of electrical conductors 428 mounted within the housing 158. Each conductor 428 includes a socket 430 for receiving a pin (e.g., see pin 320 connected to wire 322 of FIG. 11), and an exposed extension 432 for terminating a wire (e.g., see wire 324 of FIG. 11).

A. Pin Jack

In a non-limiting embodiment, the pin jack housing 158 is made of a dielectric material such as molded plastic (e.g., polycarbonate), and is molded as a single, unitary piece. The housing 158 is shown having a generally rectangular configuration including a top side 424 positioned opposite from a bottom side 426. The housing 158 is also shown including a first end 420 positioned opposite from a second end 422. The sockets 430 of the conductors 428 are accessible from the second end 422 of the pin jack housing 158. The exposed extensions 432 of the conductors 428 project outwardly from the first end 420 of the pin jack housing 158. Each of the conductors 428 extends through a separate leg or protrusion 431 of the housing 158. The protrusions 431 are separated by a gap 433.

The conductors 428 are mounted within openings 435 (best shown in FIG. 6) that extend through the housing 158 between the first and second ends 420, 422. The openings 435 include enlarged regions 437 for receiving the sockets 430. Annular retaining shoulders 439 are positioned adjacent to the enlarged regions 437.

Figure 7:
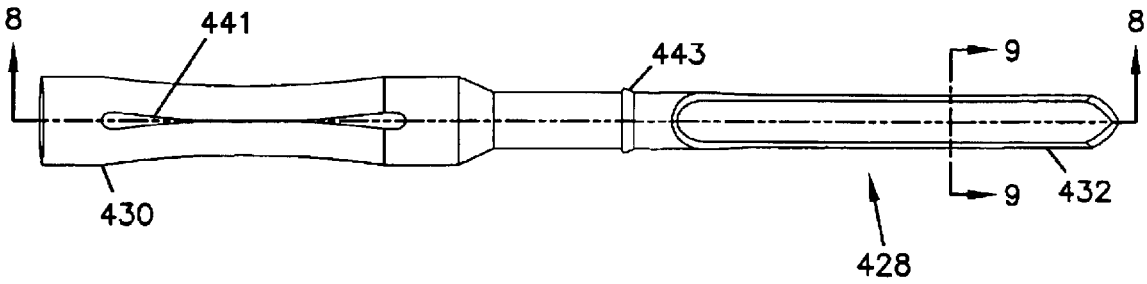
FIG. 7 illustrates one of the conductors of the pin jack of FIG. 2.
Figure 8:
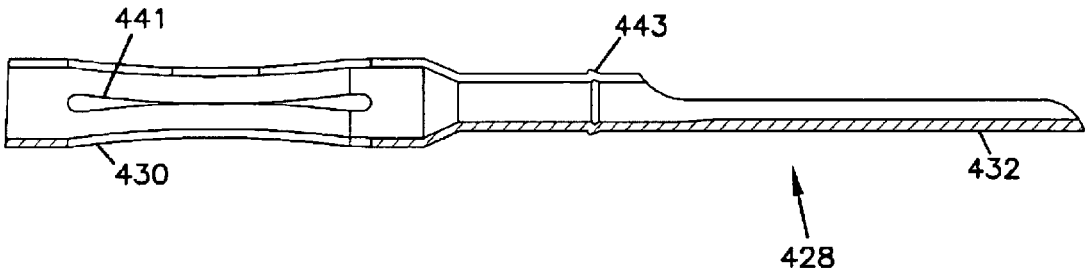
FIG. 8 is a cross-sectional view taken along section line 8—8 of FIG. 7.
Figure 9:
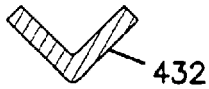
FIG. 9 is a cross-sectional view taken along section line 9—9 of FIG. 7.

Referring to FIGS. 7–9, the sockets 430 of the conductors 428 have a sleeve-like configuration. Slits 441 are cut lengthwise along the sockets 430, and the sockets 430 are crimped inwardly to enhance a frictional engagement and to provide electrical contact with a pin inserted therein. The exposed extensions 432 are shown having a V-shaped cross section (see FIG. 9). Interlock shoulders 443 are provided between the exposed extensions 432 and the sockets 430.

The conductors 428 are mounted in the housing 158 by inserting the exposed extensions 432 into the openings 435 in a direction extending from the second end 422 toward the first end 420 of the pin jack housing 158. As the conductors 428 are inserted toward the first end 420, the interlock shoulders 443 press past the annular retaining shoulders 439 thereby elastically deforming the shoulders 439 in a radially outward direction. After the interlock shoulders 443 are forced past the retaining shoulders 439, the shoulders 439 elastically move radially inwardly to lock the conductors 428 within the housing 158. In the locked position, the interlock shoulders 443 abut against first ends 451 of the retaining shoulders 439, and the sockets 430 abut against second ends 453 of the retaining shoulders 439.

While details of the conductors have been provided, it will be appreciated that any number of different configurations suitable for making electrical connections could be used. Further, while the depicted conductors are snapped within the housing, other mounting techniques such as adhesive, press-fit or integral molding could also be used. The conductors are preferably made of an electrically conducive metal material. While any number of different metals could be used, a preferred metal is beryllium copper with tin plating.

Figure 5:
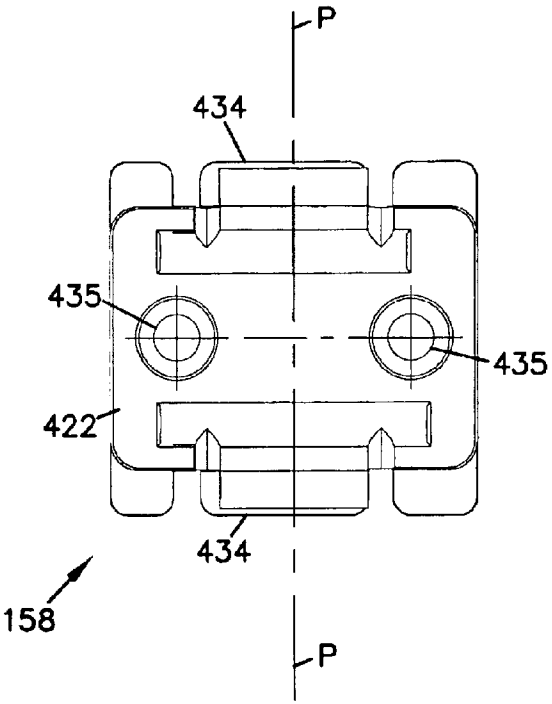
FIG. 5 is an end view of the pin jack housing of FIG. 2.
Figure 4:
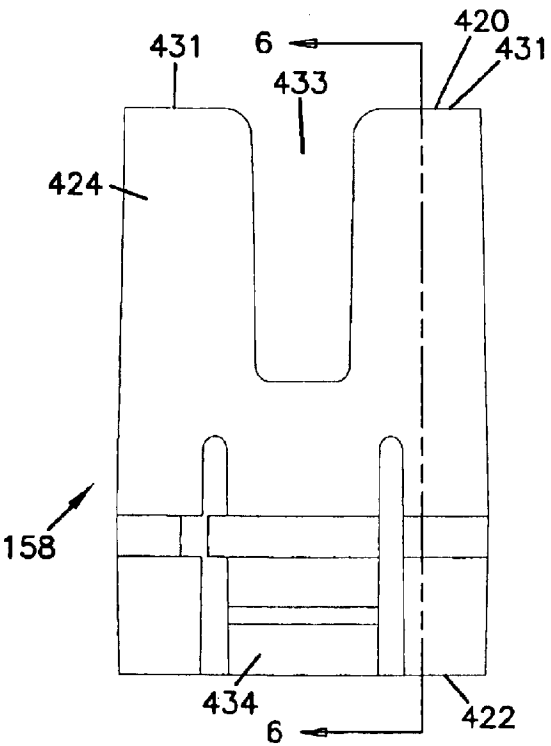
FIG. 4 is a top view of the pin jack housing of FIG. 2.
Figure 10:
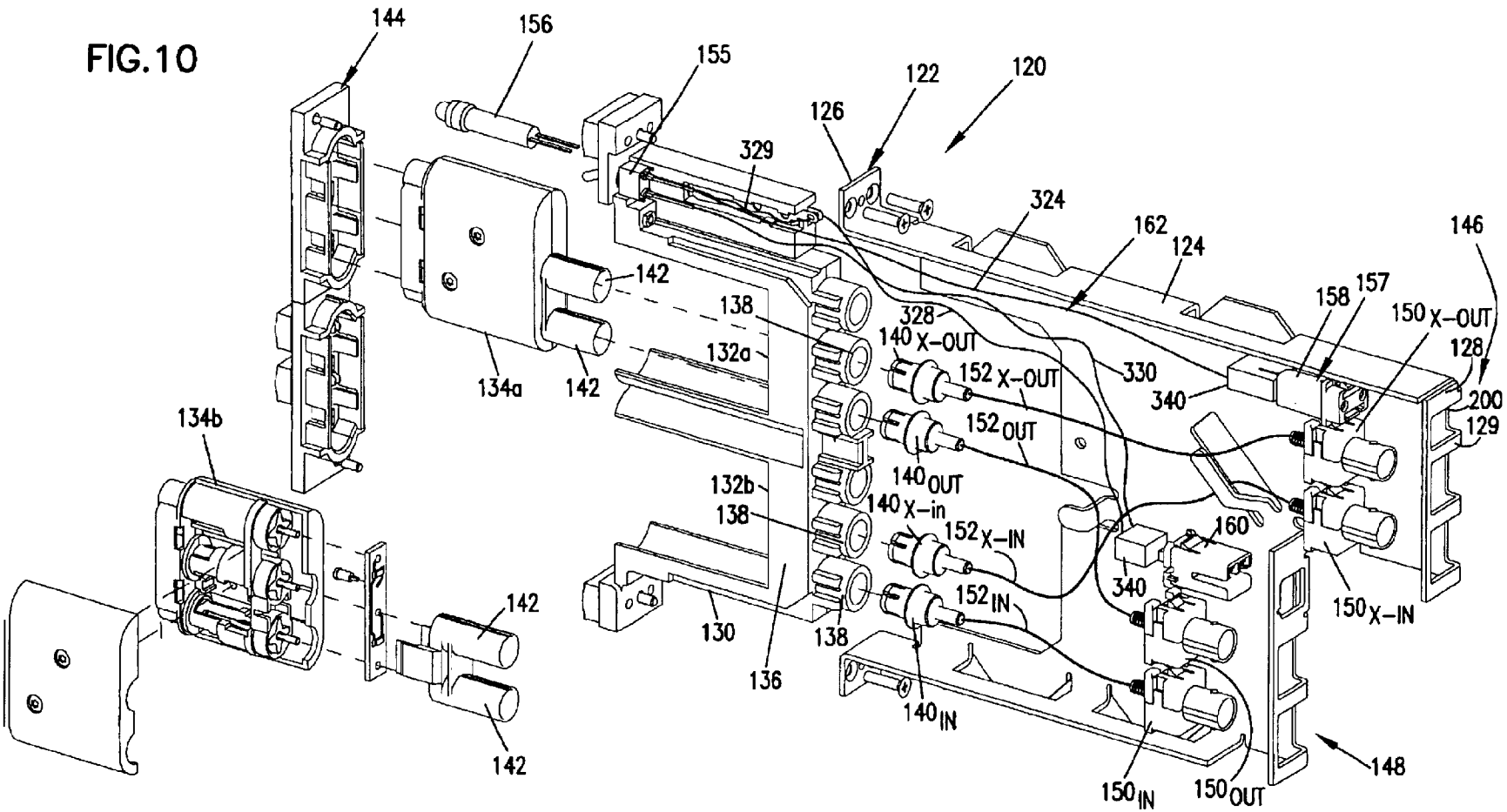
FIG. 10 is an exploded view of a jack module including the pin jack of FIG. 2.

Referring again to FIGS. 2 and 3, the housing 158 also includes structure for providing a snap-fit connection with a piece of telecommunications equipment (e.g., module 120 shown in FIG. 10). For example, resilient latches 434 each having a cantilevered configuration are provided at the top and bottom sides 424, 426 of the housing 158. The latches 434 have base ends integrally formed with the top and bottom sides 424, 426, and free ends including first retaining tabs 436. The first retaining tabs 436 include ramp surfaces 438. Each latch 434 also includes a second retaining tab 440. The second retaining tabs 440 are separated from the first retaining tabs 436 by a gap 442. The second retaining tabs 440 are positioned in alignment with fixed stops 445 that project outwardly from the housing 158. As shown in FIG. 5, the latches 434 are centered on a reference plane P that bisects the housing 158 and extends through the housing at a region located between the conductors 428.

As used herein, the phrase "snap-fit connection" means a connection provided by a resilient member that flexes or deforms past a retaining structure and moves to a locking or retaining position by the inherent flexibility or elasticity of the resilient member. The term snap-fit connection is not limited to resilient arms, but includes any structures (e.g., bumps, tabs, shoulders, etc.) that are deformed during insertion and move to a retaining position by the inherent elasticity of the structures. The resilient structures can be provided on the pin jack housing, or on the structure to which the pin jack housing is desired to be connected.

B. Jack Module

FIG. 10 illustrates a jack module 120 that is an example of a piece of telecommunications equipment to which the pin jack 157 can be secured. The jack module 120 includes a housing 122 having a main frame 124. The main frame 124 includes a front end 126 positioned opposite from a rear end 128. A front jack mount 130 is mounted at the front end 126 of the main frame 124. The front jack mount 130 includes pockets 132*a*, 132*b* for respectively receiving switching devices such as jack devices 134*a*, 134*b*. Front ends of the pockets 132*a*, 132*b* are open, and back ends of the pockets 132*a*, 132*b* are closed by a rear wall 136 of the front jack mount 130. Connector mounts 138 are defined within the rear wall 136. The connector mounts 138 are adapted for receiving jack interface connectors $\mathbf{140}_{IN}$, $\mathbf{140}_{OUT}$, $\mathbf{140}_{X\text{-}IN}$, $\mathbf{140}_{X\text{-}OUT}$ (collectively referred to with reference number 140). When the jack devices 134*a*, 134*b* are inserted within the pockets 132*a*, 132*b*, connectors 142 corresponding to the jack devices 134*a*, 134*b* interconnect with the jack interface connectors 140. The front side of the front jack mount 130 is enclosed by a removable front cover 144.

Referring still to FIG. 10, the rear end 128 of the main frame 124 includes a rear wall 129 having upper and lower connector mounting locations 146, 148. The lower mounting location 148 is inset relative to the upper mounting location 146. Rear connectors $\mathbf{150}_{X\text{-}OUT}$, $\mathbf{150}_{X\text{-}IN}$, $\mathbf{150}_{OUT}$ and $\mathbf{150}_{IN}$ (collectively referred to with reference number 150) are mounted at the rear end 128. For example, connectors $\mathbf{150}_{X\text{-}OUT}$ and $\mathbf{150}_{X\text{-}IN}$ are mounted at the upper mounting location 146, and connectors $\mathbf{150}_{OUT}$ and $\mathbf{150}_{IN}$ are mounted at the lower mounting location 148. Connectors $\mathbf{150}_{X\text{-}OUT}$ and $\mathbf{150}_{X\text{-}IN}$ are adapted for providing cross-connections between modules while the connectors $\mathbf{150}_{OUT}$ and $\mathbf{150}_{IN}$ are adapted for providing connections to network elements (e.g., telecommunications equipment). As shown in FIG. 10, cables $\mathbf{152}_{X\text{-}OUT}$, $\mathbf{152}_{X\text{-}IN}$, $\mathbf{152}_{IN}$ and $\mathbf{152}_{OUT}$ (collectively referred to with reference number 152) electrically connect the jack devices 134*a*, 134*b* to the rear connectors 150. For example, cable $\mathbf{152}_{X\text{-}OUT}$ connects connector $\mathbf{150}_{X\text{-}OUT}$ to connector $\mathbf{140}_{X\text{-}OUT}$, cable $\mathbf{152}_{X\text{-}IN}$ connects connector $\mathbf{150}_{X\text{-}IN}$ to connector $\mathbf{140}_{X\text{-}IN}$, cable $\mathbf{152}_{OUT}$ connects connector $\mathbf{150}_{OUT}$ to connector $\mathbf{140}_{OUT}$, and cable $\mathbf{152}_{IN}$ connects connector $\mathbf{150}_{IN}$ to connector $\mathbf{140}_{IN}$.

Referring still to FIG. 10, the jack module 120 is also preferably equipped with a tracer lamp circuit. The tracer lamp circuit includes a tracer lamp such as a light emitting diode (LED) 156 mounted at the front of the module 120. A tracer lamp switch 155 is positioned adjacent the LED 156. The tracer lamp circuit also includes the pin jack 157 mounted at the upper mounting location 146 and a card edge connector 160 mounted at the lower mounting location 148. A harness 162 electrically connects the card edge connector 160, the pin jack housing 158, and the switch 155 to the LED 156. It will be appreciated that the pin jack housing 158 is adapted for connecting the tracer lamp circuit 154 to the tracer lamp circuit of a cross-connected jack module, and the card edge connector 160 is adapted for connecting the tracer lamp circuit 154 to power and ground.

The jack module is also disclosed in U.S. application Serial No. (not yet assigned) entitled Digital Switching Cross-Connect Module, which has Attorney Docket No. 2316.1362US01, which was filed on a date concurrent herewith, and which is hereby incorporated by reference in its entirety.

C. Mounting Method

Referring to FIG. 10, the pin jack housing 158 is sized to be mounted in a rectangular opening 200 defined at the upper mounting location 146 of the rear wall 129 of the jack module 120. The pin jack housing 158 is mounted in the opening 200 by inserting the second end 422 of the pin jack housing 158 rearwardly through the opening 200. As the pin jack housing 158 is pressed through the opening 200, engagement between top and bottom edges of the opening and the ramped surfaces 438 of the first return tabs 436 causes the latches 434 to be flexed toward one another to allow the first tabs 436 to pass through the opening 200. Once the first tabs 436 pass through the opening 200, the latches 438 flex away from one another and "snap" into a locked position. In the locked position, the first tabs 436 engage the back side of the rear wall 129 and the second retaining tabs 440 engage or oppose the front side of the rear wall 129. Similarly, the fixed stops 444 also oppose the front side of the rear wall 129.

To remove the pin jack housing 158, the latches 434 can be flexed inwardly thereby allowing the housing 158 to be dislodged from the opening 200 by pushing the housing 158 in a forward direction. In other embodiments, the pin jack housing 158 can be configured to be inserted into the opening 200 from the rear end of the jack module 120.

Figure 1:
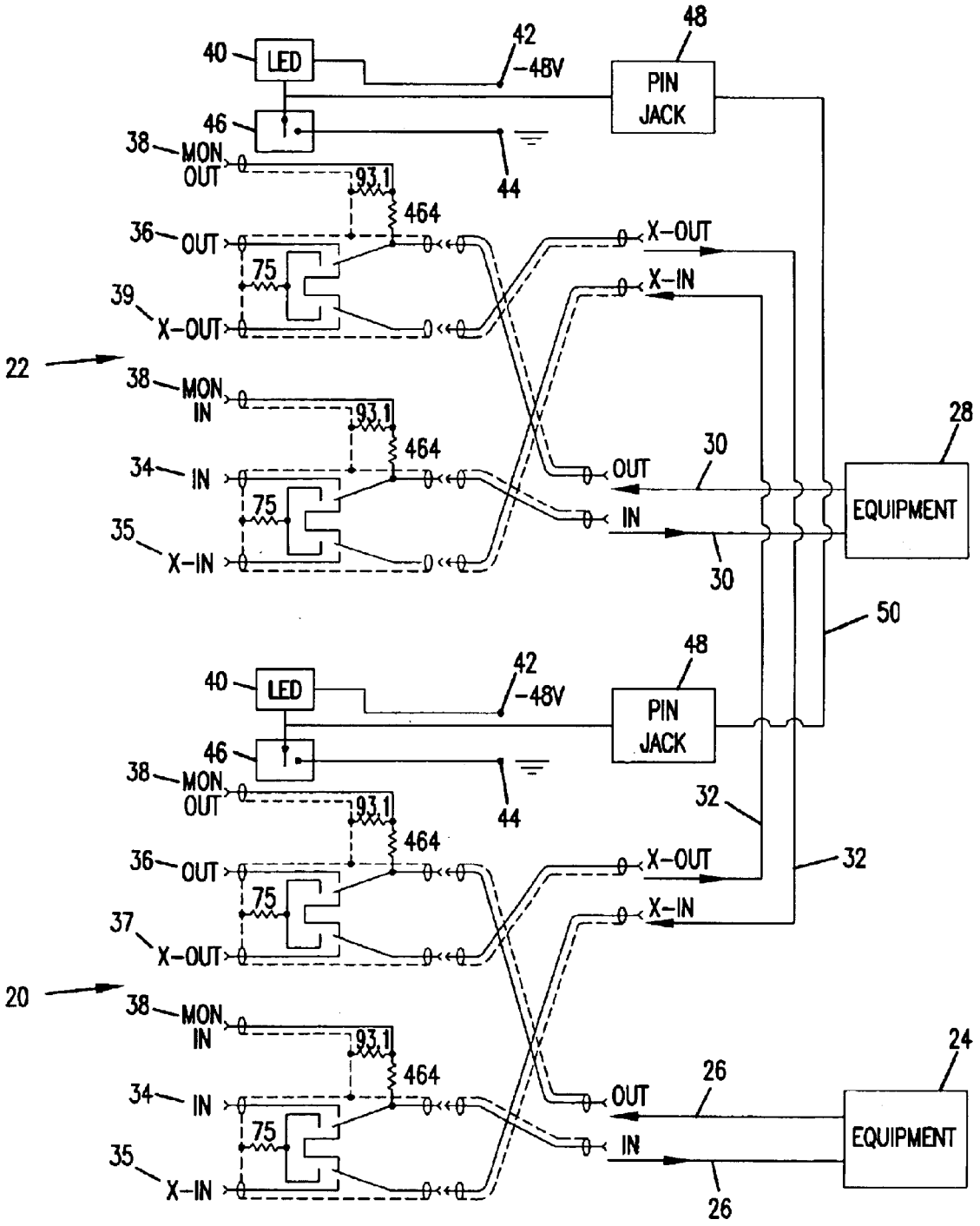
FIG.1 PRIOR ART
FIG. 1 shows a prior art cross-connect arrangement of the type used for co-axial applications.
Figure 2:
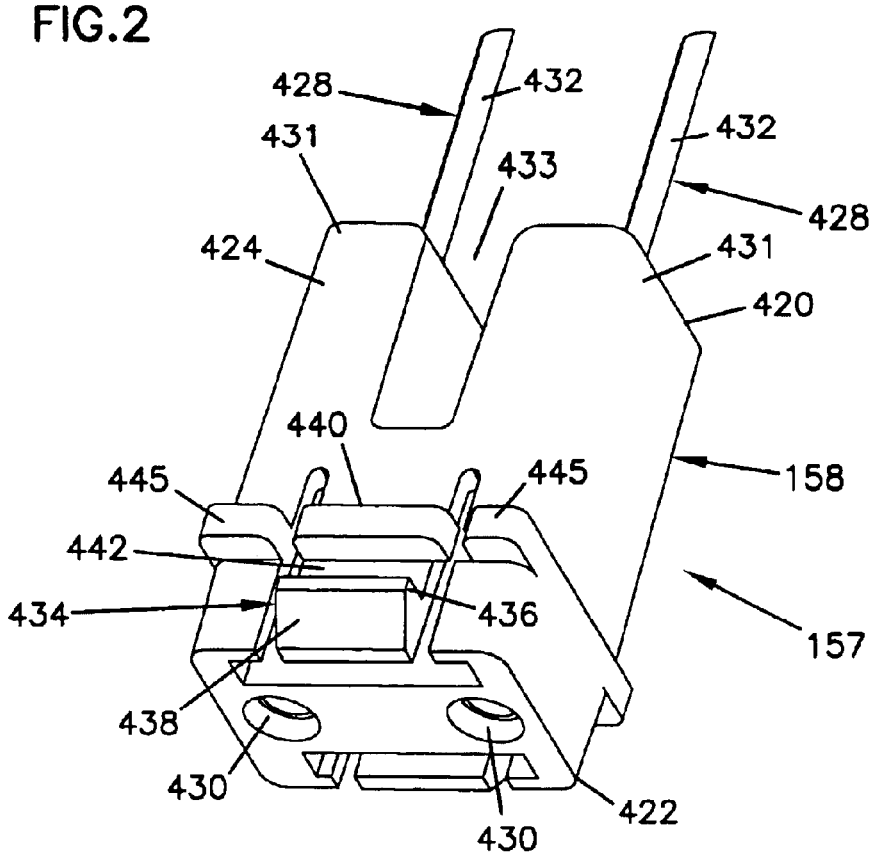
FIG. 2 is a top, perspective view of a pin jack having features that are examples of how various inventions disclosed herein can be practiced.
Figure 3:
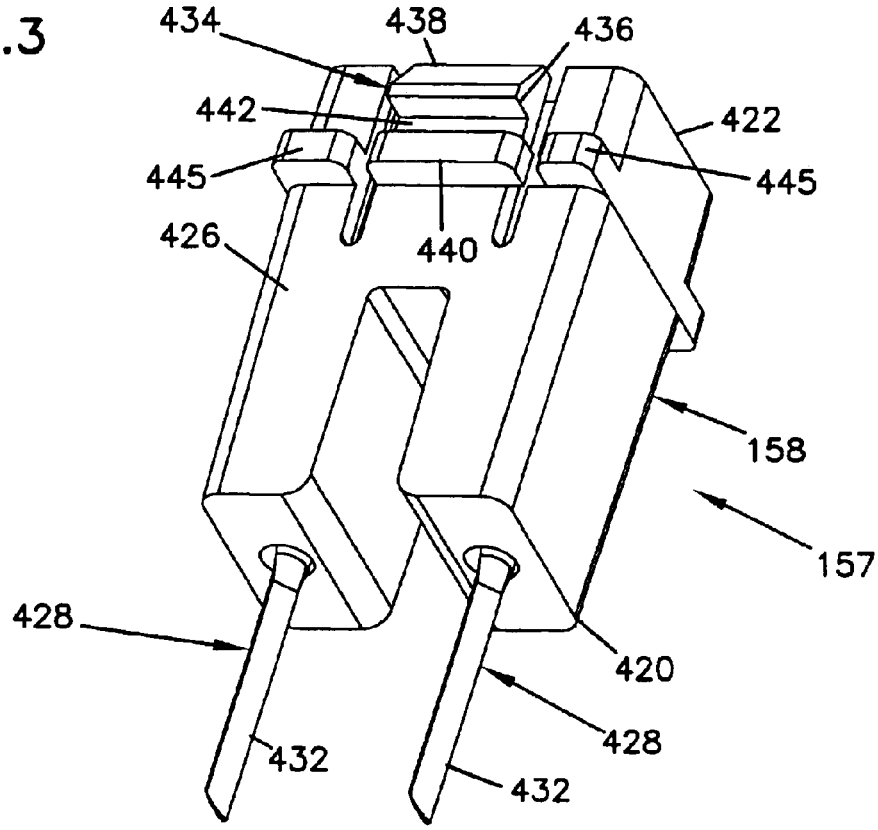
FIG. 3 is a bottom, perspective view of the pin jack of FIG. 2.
Figure 6:
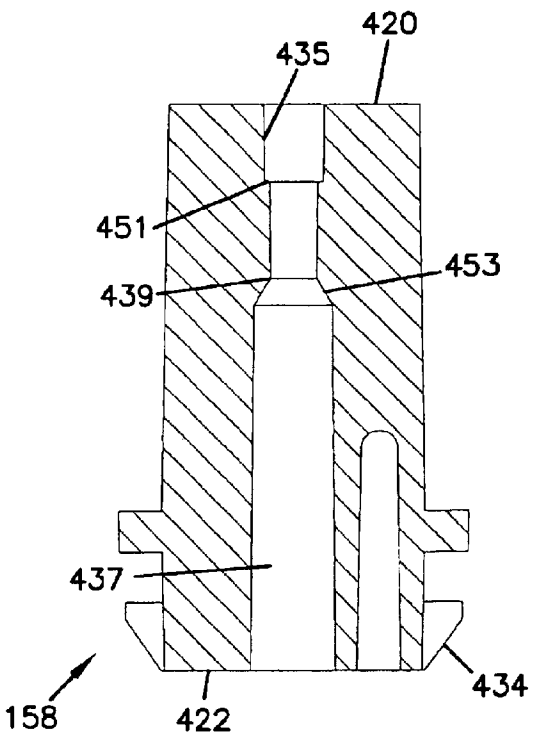
FIG. 6 is a cross-sectional view taken along section line 6—6 of FIG. 4.

As shown in FIGS. 2 and 3, the sides of the housing 158 are shown having identical configurations. However, in other embodiments, different snap-fit configurations can be provided on the sides of the pin jack housing. Further, in some embodiments, only one snap-fit structure may be provided. It will be appreciated that the snap-fit structure could be provided on the top, the bottom or either side of the housing. Further, the housing 158 can also include a snap fit configuration that allows for bi-directional insertion of the housing into a mounting opening. An exemplary type of bi-directional insertion configuration is disclosed in U.S. application Serial No. (not yet assigned) entitled Telecommunications Connector Adapted for Bi-Directional Insertion, which has Attorney Docket No. 2316.1690US01, which was filed on a date concurrent herewith, and which is hereby incorporated by reference in its entirety.

D. Tracer Lamp Circuitry

FIG. 111 schematically shows the two DSX jack modules 120*a*, 120*b* cross-connected together by wires 300. Each of the jack modules 120*a*, 120*b* includes a tracer lamp circuit including switch 155, LED 156, pin jack 157, and wires electrically interconnecting the components. The wires include wires 324 connecting pin jacks 157 to the switches 155, wires 326 providing jumpers between the conductors 428 of the pin jacks 157, wires 328 connecting the LED's 156 to power wires 329 connecting the switches 155 to the LED's 156, and wires 330 connecting the switches 155 to ground. Tracer lamp circuits of the jack modules 120*a*, 120*b* are interconnected by wire 322. The wire 322 includes connection pins 320 inserted within the sockets 430 of the conductors 428 of the pin jacks 157. The pin jacks 157 each include an extra conductor 428 that is connected to the respective tracer lamp circuit, but is not currently shown in use. The extra connectors provide locations for accessing the tracer lamp circuits without requiring the tracer lamp circuits of the jack modules 120*a*, 120*b* to be disconnected from one another (i.e., by removing pins 320 from their respective sockets 430).

It will be appreciated that the wires 324, 326, 328 and 330 can be terminated to their respective components by conventional techniques such as wire wrap connections, soldering, crimping or via terminals. In FIG. 10, the wires 324, 328 and 330 are shown connected to the pin jack 157 and the card edge connector 160 by push-in-place connectors 340. The term "push-in-place" connectors means the connectors provide an electrical connection by merely pushing the connectors over corresponding conductive elements (e.g., pins) without requiring wire wrapping or soldering.

E. Alternative Embodiments

Figure 12:
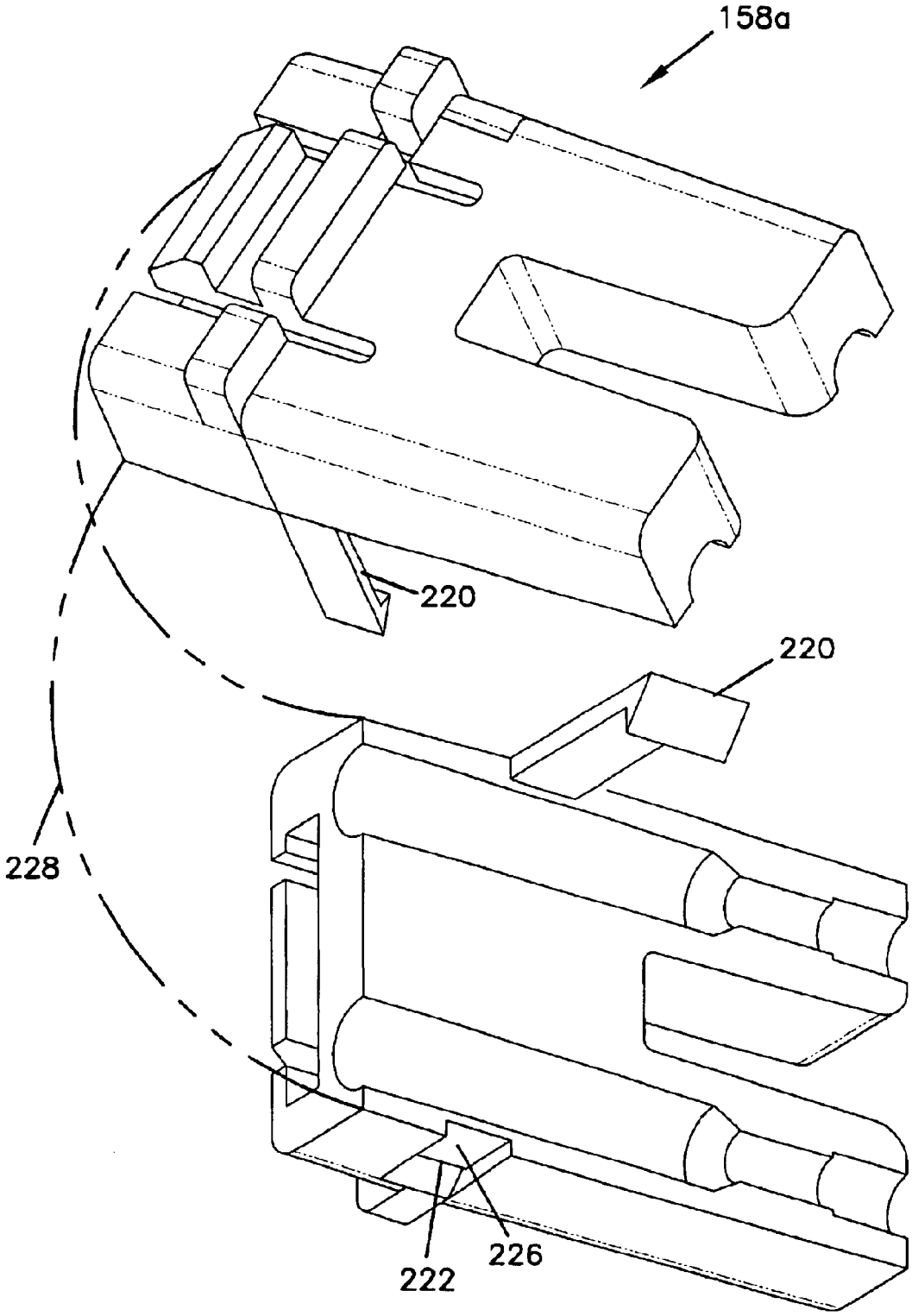
FIG. 12 illustrates another embodiment of a pin jack having features that are examples of how various inventions disclosed herein can be practiced.

FIG. 12 shows an alternative pin jack housing 158*a* adapted for holding the conductors 328 (shown in FIGS. 7–9). The housing 158*a* has the same configuration as the housing 158 of FIGS. 2 and 3, except that the housing 158*a* has a 2-part configuration. The two parts of the housing 158*a* are interconnected by a snap-fit configuration including resilient latches 220 that interlock with shoulders 222 when the pieces are snapped together. The shoulders 222 are positioned within guide grooves 226 for guiding the latches 220 into the snapped configuration. An optional living hinge 228 can be used to interconnect the two pieces of the housing 158*a*. While a snap fit connection is preferred between the pieces, other connection techniques such as adhesive or press-fit connections could also be used.

Figure 13:
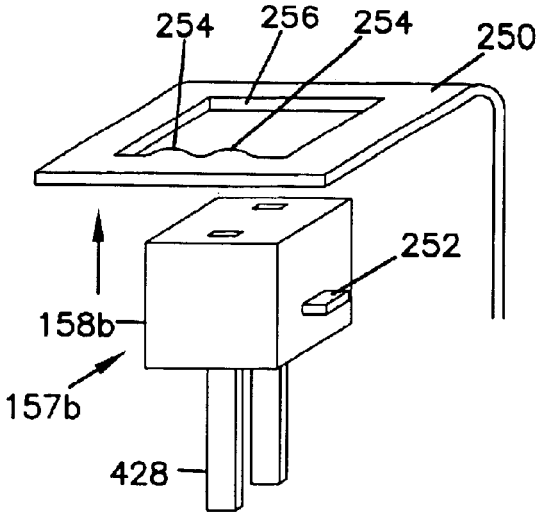
FIGS. 13–15 show a sequence for mounting a further embodiment of a pin jack having features that are examples of how various inventions disclosed herein can be practiced.
Figure 14:
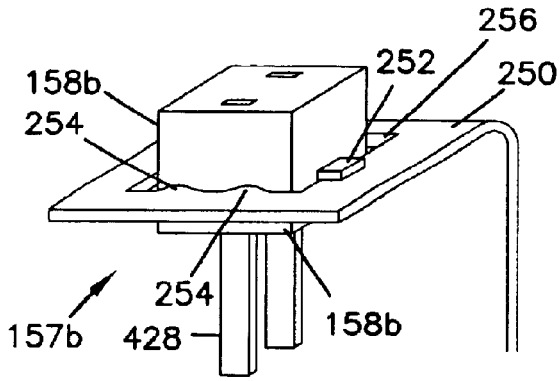
Figure 15:
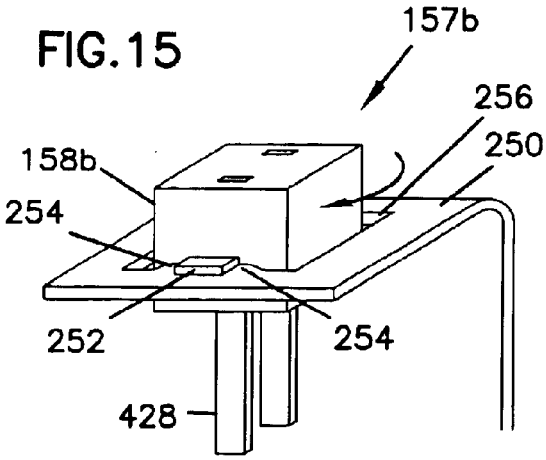

FIGS. 13–15 show an alternative pin jack 157*b* having a housing 158*b* in which two conductors 428 are mounted. The housing 158*b* includes a modified snap-fit structure for connecting the pin jack 157*b* to a piece of telecommunications equipment 250. The modified snap fit structure includes a bump or tab 252 that projects outwardly from the main body of the housing 158*b*. The tab 252 cooperates with bumps 254 of the equipment to provide the snap-fit connection. The bumps 254 project into an opening 256 defined by the equipment 250. By inserting the pin jack 157*b* into the opening 256 as shown in FIGS. 13 and 14, and turning the pin jack 157*b* to a position where the tab 252 snaps between the bumps 254, the pin jack 157*b* is locked in place as shown in FIG. 15. It will be appreciated that either the housing 158*b* or the opening 256 are preferably rounded (i.e., radiused) to allow for the housing 158*b* to be rotated within the opening 256.

Figure 16:
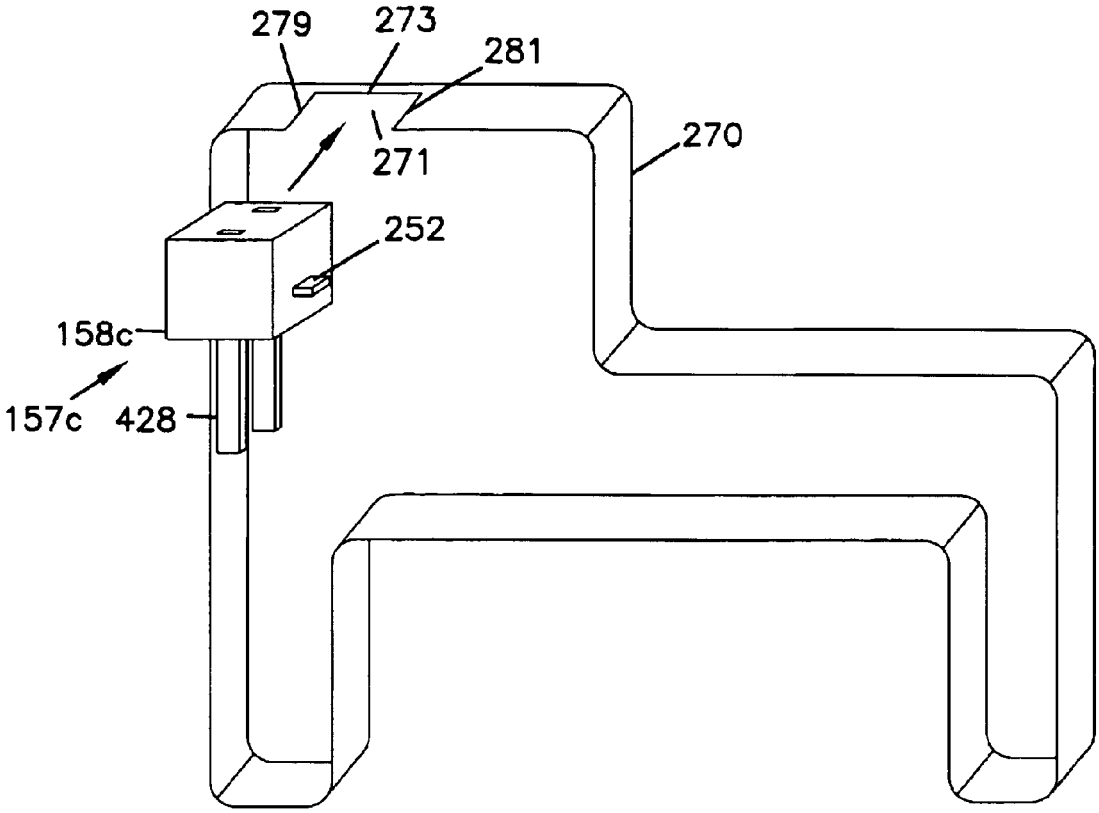
FIG. 16 is another embodiment of a pin jack having features that are examples of how various inventions disclosed herein can be practiced.

FIG. 16 show an alternative pin jack 157*c* having a housing 158*c* in which conductors 428 are mounted. The pin jack 157*c* mounts to a piece of telecommunications equipment 270 by sliding the pin jack 157*c* though an open side 271 of an opening 273 defined by the equipment 270. The housing 158*c* can include slots or grooves (not shown) for receiving edges 279, 281 of the opening 273. Alternatively, if the edges 279, 281 are defined by a relatively hard material such as sheet metal, and the housing 158*c* is made of a softer material such as plastic, grooves need not be provided in the housing 158*c* as the edges 279, 281 will self-cut grooves in the plastic during the insertion process. To facilitate insertion, in an alternative embodiment, the edges 279, 281 can be angled so as to converge as the edges 279, 281 extend away from the open side 271 of the opening 273.

It will be appreciated that many embodiments of the inventions can be made without departing from the spirit and scope of the inventions, and that the broad scopes of the inventions are not intended to be limited by the specific embodiments depicted and described herein.

What is claimed is:

1. A cross-connect module comprising:

a module housing having a front end and a rear end;

a plurality of switching devices positioned adjacent the front end of the module housing;

a plurality of rear connectors mounted adjacent the rear end of the module housing;

cables positioned within the housing that electrically couple the rear connectors to the switching devices;

a pin jack mounted adjacent the rear end of the housing, the pin jack including a single pin jack housing in which two conductors are mounted, the conductors including sockets adapted for receiving pins; and a tracer lamp circuit electrically connected to at least one of the conductors of the pin jack.

2. The cross-connect module of claim 1, wherein the pin jack housing is generally rectangular.

3. The cross-connect module of claim 2, wherein the rear end of the module housing includes a rear wall defining a rectangular opening, and wherein the pin jack housing is mounted within the rectangular opening.

4. The cross-connect module of claim 1, wherein the pin jack housing includes a single, unitary piece.

5. The cross-connect module of claim 4, wherein the single, unitary piece includes molded plastic.

6. The cross-connect module of claim 1, wherein the pin jack housing includes at least two pieces interconnected together.

7. The cross-connect module of claim 6, wherein the two pieces are interconnected by a snap-fit connection.

8. The cross-connect module of claim 6, further comprising a living hinge that connects the two pieces together.

9. The cross-connect module of claim 1, wherein the pin jack housing is connected to the module housing by a snap-fit connection.

10. The cross-connect module of claim 9, wherein the pin jack housing includes at least one flexible latch for providing the snap-fit connection.

11. The cross-connect module of claim 10, wherein the pin jack housing includes two flexible latches positioned at opposite sides of the pin jack housing.

12. The cross-connect module of claim 11, wherein the flexible latches are centered relative to a reference plane that extends through a region of the housing located between the conductors.

13. The cross-connect module of claim 12, wherein the reference plane does not intersect the conductors.

14. The cross-connect module of claim 13, wherein the reference plane bisects the pin jack housing.

15. The cross-connect module of claim 1, wherein the conductors are electrically connected to one another.

16. A cross-connect device comprising:

a plurality of switching devices;

a plurality of connectors electrically coupled to the switching devices;

a pin jack, the pin jack including a single pin jack housing configured to be secured within an opening defined by a piece of telecommunications equipment, the single pin jack housing including first and second ends, and the single pin jack housing defining two conductor mounting openings that extend between the first and second ends, the pin jack also including conductors mounted within the conductor mounting openings, the conductors including sockets accessible from the first end of the pin jack housing and tails that project from the second end of the pin jack housing; and a tracer lamp circuit electrically connected to at least one of the conductors of the pin jack, the tracer lamp circuit including circuitry for identifying two switching devices that are cross-connected to each other.

17. The cross-connect device of claim 16, wherein the pin jack housing is generally rectangular.

18. The cross-connect device of claim 16, wherein the pin jack housing includes a single, unitary piece.

19. The cross-connect device of claim 16, wherein the pin jack housing includes at least two pieces interconnected together.

20. The cross-connect device of claim 16, wherein the pin jack housing includes structure for providing a snap-fit connection with the piece of telecommunications equipment.

21. The cross-connect device of claim 16, wherein the pin jack housing includes at least one flexible latch for providing a snap-fit connection with the piece of telecommunications equipment.

22. The cross-connect device of claim 21, wherein the pin jack housing includes two flexible latches positioned at opposite sides of the pin jack housing.

23. The cross-connect device of claim 22, wherein the flexible latches are centered relative to a reference plane that extends through a region of the housing located between the conductors.

24. The cross-connect device of claim 23, wherein the reference plane does not intersect the conductors.

25. The cross-connect device of claim 24, wherein the reference plane bisects the pin jack housing.

* * * * *